US005295468A

United States Patent [19]

Blessing et al.

[11] Patent Number: 5,295,468

[45] Date of Patent: Mar. 22, 1994

[54] CONTROL STRIP WITH A COMPACT PLASTIC CONSTRUCTION

[75] Inventors: Heinz Blessing, Weissach; Manfred Mueller, Frieberg; Joachim Schraudolf, Heilbronn, all of Fed. Rep. of Germany

[73] Assignee: Filterwerk Mann & Hummel GmbH, Ludwigsburg, Fed. Rep. of Germany

[21] Appl. No.: 883,453

[22] Filed: May 15, 1992

[30] Foreign Application Priority Data

May 17, 1991 [DE] Fed. Rep. of Germany ..... 4116326
Jul. 20, 1991 [DE] Fed. Rep. of Germany ..... 4124201

[51] Int. Cl.[5] ..... F02M 55/02; F02M 69/00; F02M 61/14

[52] U.S. Cl. ..... 123/456; 439/130; 123/472

[58] Field of Search ..... 123/456, 468, 469, 470, 123/472; 439/130

[56] References Cited

U.S. PATENT DOCUMENTS

| | | | |
|---|---|---|---|
| 4,307,693 | 12/1981 | Glockler et al. | 123/470 |
| 4,570,601 | 2/1986 | Ito et al. | 123/468 |
| 4,844,036 | 7/1989 | Bassler et al. | 123/470 |
| 4,857,003 | 8/1989 | Hafner et al. | 439/130 |
| 4,895,124 | 1/1990 | Bartholomew | 123/510 |
| 4,950,171 | 8/1990 | Muzslay | 123/456 |
| 5,016,594 | 5/1991 | Hafner et al. | 123/470 |
| 5,030,116 | 7/1991 | Sakai et al. | 123/456 |
| 5,086,743 | 2/1992 | Hickey | 123/456 |
| 5,111,794 | 5/1992 | DeGrace, Jr. | 123/456 |
| 5,127,382 | 7/1992 | Imoehl | 123/456 |
| 5,131,857 | 7/1992 | Gmelin et al. | 123/456 |
| 5,143,039 | 9/1992 | Gmelin | 123/456 |
| 5,154,622 | 10/1992 | Ehrentraut et al. | 123/470 |
| 5,168,857 | 12/1992 | Hickey | 123/456 |
| 5,178,114 | 1/1993 | McArthur | 123/456 |
| 5,178,115 | 1/1993 | Daly | 123/456 |
| 5,238,415 | 8/1993 | Bittner et al. | 439/130 |

FOREIGN PATENT DOCUMENTS

| | | |
|---|---|---|
| 306739 | 8/1991 | European Pat. Off. . |
| 2926490 | 2/1981 | Fed. Rep. of Germany . |
| 3843214 | 6/1990 | Fed. Rep. of Germany . |
| 3907764 | 9/1990 | Fed. Rep. of Germany . |
| 3914487 | 11/1990 | Fed. Rep. of Germany . |

*Primary Examiner*—E. Rolins Gross
*Assistant Examiner*—Thomas Moulis
*Attorney, Agent, or Firm*—Everson, McKeown, Edwards & Lenahan

[57] ABSTRACT

A method of manufacturing a control strip for injection valves in plastic fuel lines of an internal combustion engine, comprising forming a conductive preform defining at least two conductive elements initially connected by removable bridges formed of the same material as the conductive elements for controlling said injection valves; embedding said preform in an insulting plastic; removing the bridges between the conductive elements to electrically isolate the conductive elements from each other; and thereafter casting the plastic-embedded and electrically isolated conductive elements into a one-piece control strip which serves as a housing and electrical control strip for the injection valves.

15 Claims, 2 Drawing Sheets

CONTROL STRIP WITH A COMPACT PLASTIC CONSTRUCTION

BACKGROUND OF THE INVENTION

A fuel injection system for an internal combustion engine is known which includes a fuel distributor comprising a plastic body extending along the side of the engine with a fuel supply duct formed therein. Fuel injection valves are mounted in the body at spaced intervals along its length. It is necessary to establish an electrical connection to control the valves.

The present invention relates to a control strip, in particular to a control strip for the injection valves in a plastic fuel duct of an internal combustion engine. The invention also relates to a method of manufacturing a control strip of the foregoing type.

Such control strips are disclosed in German published patent application No. DE 39 14 487, for example, in the form of a contact strip which can control a plurality of injection valves in concert with only two current-carrying wires. If it is desired to use such contact strips for individually controlling the injection nozzles of multicylinder internal combustion engines, for example, the disadvantage is that the large number of control wires which are necessary to achieve individual control are inconveniently in the way both during assembly and during maintenance.

A possible solution to this problem would be to preassemble a wiring harness and install it by hand. This, however, would be inconvenient, and because such an arrangement is expensive to manufacture, it would increase the cost of the contact bar. Also, when the housing was repeatedly opened and closed, as occurs during service and repair, it would be impractical.

SUMMARY OF THE INVENTION

It is therefore the object of the present invention to provide an improved contact strip of the kind described above which avoids the aforementioned disadvantages.

Another object of the invention is to provide a control strip which facilitates reliable, individually controlled operation of a plurality of fuel injection valves of a multi-cylinder internal combustion engine and is simpler and less expensive to manufacture, install and service.

These and other objects of the invention are achieved by providing a control strip for injection valves in plastic fuel lines of an internal combustion engine, wherein said control strip is formed with a compact plastic construction and contains at least two conductive elements for controlling said injection valves.

In accordance with a further aspect of the invention, the objects are achieved by providing a method of manufacturing a control strip for injection valves in plastic fuel lines of an internal combustion engine, comprising forming the control strip with a compact plastic construction having embedded therein at least two conductive elements for controlling said injection valves.

BRIEF DESCRIPTION OF THE DRAWINGS

The invention will be described in further detail hereinafter with reference to illustrative preferred embodiments depicted in the accompanying drawings in which.

DETAILED DESCRIPTION OF THE PREFERRED EMBODIMENTS

Figure 1:
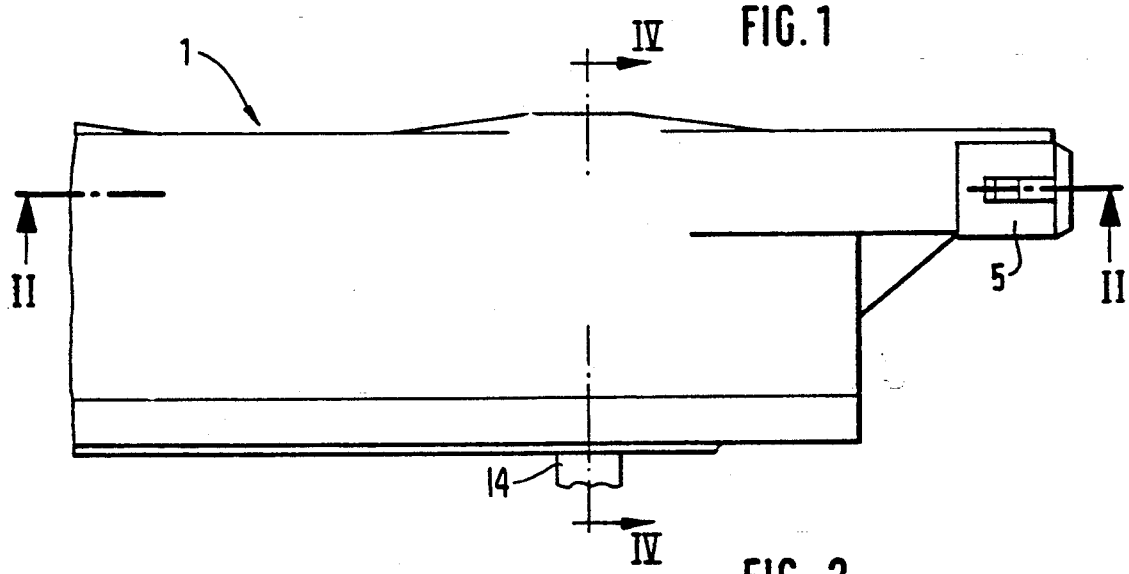
FIG. 1 is a side elevational view of a control strip according to the present invention.
Figure 2:
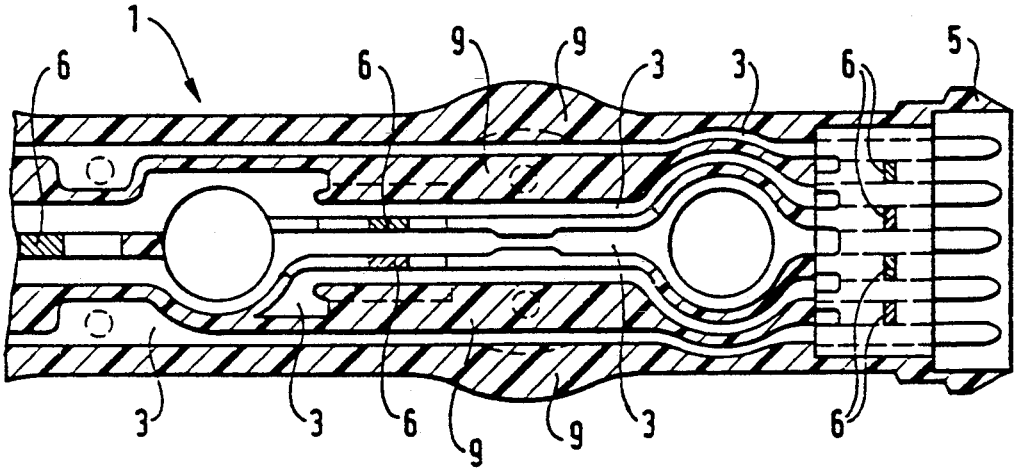
FIG. 2 is a sectional view taken along line II—II of FIG. 1.
Figure 3:
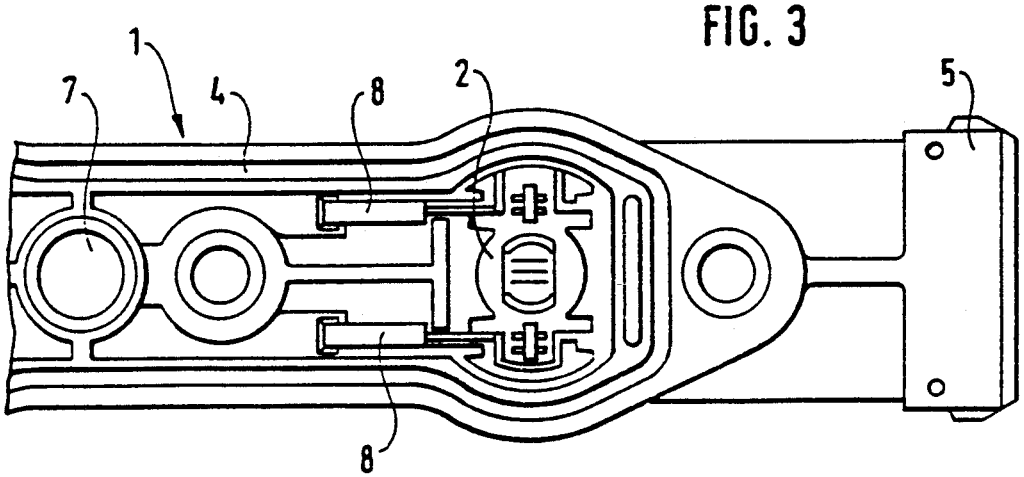
FIG. 3 is a bottom plan view of the control strip of FIG. 1.
Figure 4:
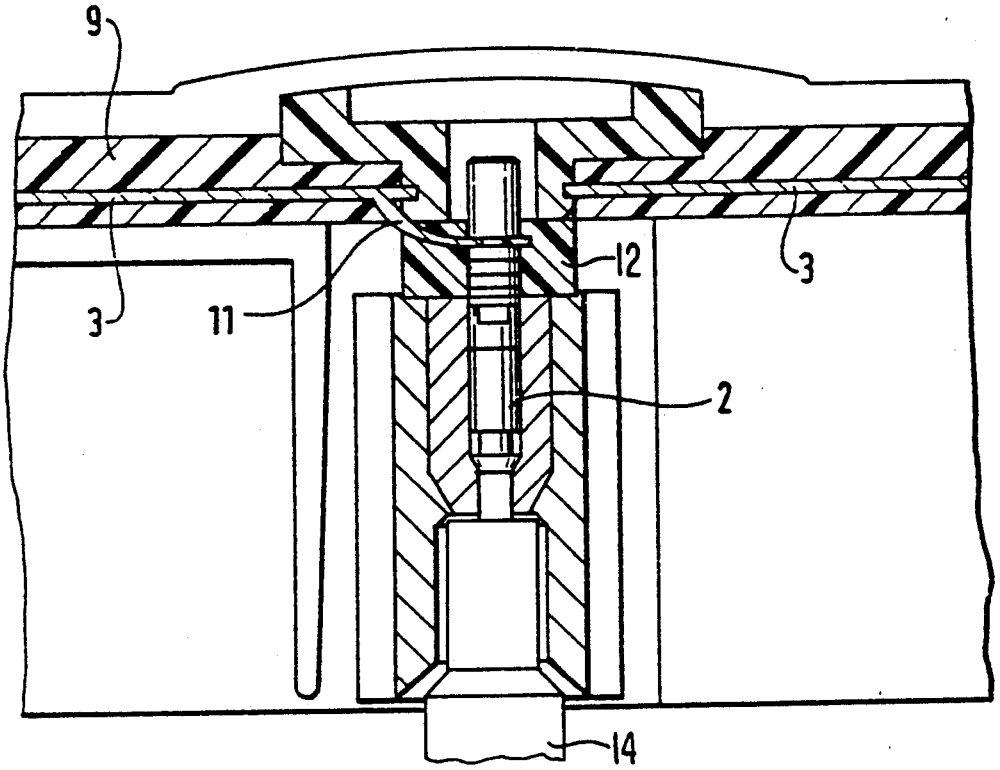
FIG. 4 illustrates a sectional view taken along line IV/V—IV/V of FIG. 1, showing electrical contact made by means of spring elements.

A control strip 1 made of synthetic resin material (plastic) 9, which has, as a multi-purpose device, both an injection valve socket 2, and which simultaneously serves to control the aforementioned injection valves by means of conductive elements 3, also serves as a protective cover for the injection valves to be provided in any desired number on a fuel line of plastic, for example. A gasket 4, which is fixed in a groove, prevents contamination and the resultant leakage currents, and assures high operating reliability of the electrical parts.

The control strip 1, which is formed with a compact plastic construction, especially as a robust injection die-cast part, is designed with a single plug strip 5 so that it can be manipulated with one hand during assembly and maintenance, thereby making it possible for the injection valves 14 to be replaced with the other hand.

The injection valves 14 are mounted floatingly by means of resilient blocks 12 so as to assure trouble-free operation and to avoid damage caused through mechanical stresses and/or vibrations. The larger cross section of the conductive elements 3 assures lower voltage losses. For simpler production of the plug strip 1, the conductive elements 3 are initially connected by removable bridges or assembly aids 6. The assembly aids 6 provide the required form-stability for the conductive elements 3 during the die-casting. Use of such assembly aids 6 makes it possible to eliminate a few assembly steps. In the illustrated embodiment, the assembly aids 6, which are made of the same copper material as the conductive strips, are removed again, especially with a punching tool, before the control strip 1 is completed, to avoid short circuits between the conductive elements.

To facilitate one-handed assembly, the control strip 1 is equipped with a centering-hole 7 which receives a mating centering pin on the mating part to assure proper positioning of the control strip.

The electrical connection to the injection valve socket 2 is effected in this embodiment by electrical contact pins 8, in connection with either flexible cable 10 (e.g. braided cable) or stiff spring elements 11.

Figure 5:
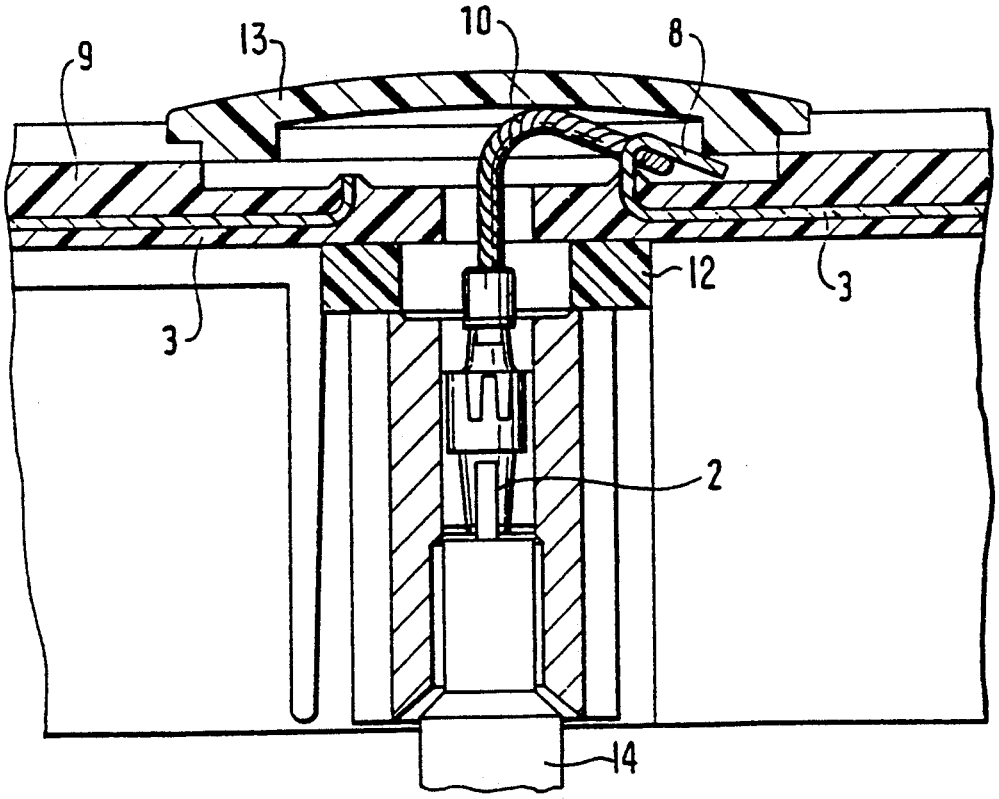
FIG. 5 illustrates an alternate embodiment sectional view taken along line IV/V—IV/V of FIG. 1, showing electrical contact made by means of flexible stranded wires.

In the embodiment of FIG. 5, a removable cover 13 is provided to enable a mechanic to gain access to the electrical contact pin 8 and facilitate its ready connection to flexible cable 10 which leads to the socket 2 for the injection valve 14.

Although formerly a plurality of individual parts were needed in order to control the valves individually as in the example, the control strip 1 with all its functions is only a single piece. In the example, the conductive elements 3 are electrically insulated by the plastic material 9 of the housing.

The conductive elements 3 could also be insulated cables.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all variations falling within the ambit of the appended claims and equivalents thereof.

What is claimed is:

1. A method of manufacturing a control strip for injection valves in plastic fuel lines of an internal combustion engine, comprising forming a conductive preform defining at least two conductive elements initially connected by removable bridges formed of the same material as the conductive elements for controlling said injection valves; embedding said preform in an insulating plastic; removing the bridges between the conductive elements to electrically isolate the conductive elements from each other; and thereafter casting the plastic-embedded and electrically isolated conductive elements into a one-piece control strip which serves as a housing and electrical control strip for the injection valves.

2. A method of manufacturing a control strip according to claim 1, wherein said control strip is provided with electrical contact pins for electrically connecting said control strip to the injection valves.

3. A method of manufacturing a control strip according to claim 1, wherein said injection valves are integrated into the control strip.

4. A method of manufacturing a control strip according to claim 1, wherein said control strip is electrically connected via a plug-in connection to said injection valves integrated in the fuel line.

5. A method of manufacturing a control strip according to claim 1, wherein said preform is manufactured by etching, pressing or stamping.

6. A method of manufacturing a control strip according to claim 1, wherein said control strip controls a plurality of separate injection valves individually.

7. A method of manufacturing a control strip according to claim 1, wherein said control strip controls a plurality of injection valves in concert.

8. A method of manufacturing a control strip according to claim 1, wherein said conductive elements are surface-treated.

9. A method of manufacturing a control strip according to claim 1, wherein said injection valves integrated in said control strip are dampingly mounted.

10. A method of manufacturing a control strip according to claim 1, wherein said conductive elements extend together to a common plug strip.

11. A method of manufacturing a control strip according to claim 2, wherein said plug strip is provided with a centering device (7) to facilitate one-handed installation.

12. A method according to claim 1, wherein said bridges are removed by punching.

13. A method of manufacturing a control strip according to claim 2, wherein said contact pins are electrically connected to said injection valves via flexible stranded wires.

14. A method of manufacturing a control strip according to claim 2, wherein said contact pins are electrically connected to said injection valves via by stiff spring elements.

15. A method of manufacturing a control strip according to claim 3, wherein said injection valves integrated in the control strip are floatingly mounted.

* * * * *